US006059258A

United States Patent [19]

Jackson

[11] Patent Number: 6,059,258

[45] Date of Patent: May 9, 2000

[54] MODULAR SHORING FRAME AND SYSTEM

[76] Inventor: George W. Jackson, 2570 Drew Road, Mississauga, Ontario, Canada, L4T 3M5

[21] Appl. No.: 09/168,691

[22] Filed: Oct. 9, 1998

[51] Int. Cl.[7] ..... E04G 11/00

[52] U.S. Cl. ..... 249/18; 249/210

[58] Field of Search ..... 249/18, 28, 205, 249/207, 210; 52/263, 126.5, 126.6; 182/222; 108/150

[56] References Cited

U.S. PATENT DOCUMENTS 3,430,910 3/1969 Bowden et al. ..... 249/18
4,470,574 9/1984 Jackson .
4,841,708 6/1989 Johnston ..... 249/18
4,926,593 5/1990 Johnston ..... 52/126.5
4,984,654 1/1991 Anderson ..... 182/222

*Primary Examiner*—Michael Safavi
*Attorney, Agent, or Firm*—L. Anne Kinsman

[57] ABSTRACT

A support structure for temporarily shoring poured concrete slabs in place. The support structure can be assembled and/or disassembled on site. The structure includes post shores which act as the legs of a shoring tower when assembled with ledgers, stringers, joists and/or cross braces, but can also be used separately as single post shores. The support structure can be adjusted to a number of heights and configurations. The ledgers are mounted to the post shores with T-bolts for ease of assembly and disassembly.

7 Claims, 4 Drawing Sheets

MODULAR SHORING FRAME AND SYSTEM

FIELD OF THE INVENTION

This invention relates to support frames for shoring poured concrete slabs. In particular, this invention relates to modular shoring frames and post shores for temporarily supporting poured concrete floors.

BACKGROUND OF THE INVENTION

It is common practice in the construction industry to shore newly poured concrete slabs with a temporary support frame. For large slabs, such as those forming building floor structures, a number of shoring frames must be used. Generally, the support frames remain in place until the slab has cured sufficiently to allow the safe removal of the frame(s). Prior art shoring frames have generally comprised a pair of legs that are laterally spaced apart and interconnected by suitable bracing members, such as horizontal ledgers. The bracing members are welded, or otherwise permanently fixed, to the legs. Typically, the legs have screwjacks at one or both ends which can be adjusted to fix the height of the frame to the desired height of the slab.

When it is desired to pour a concrete a slab, a number of spaced apart frames are generally interconnected to form a shoring tower. The frames must be lifted into place and cross braces are generally secured between adjacent frames to interconnect the frames to form a tower. To the top of each leg in the tower can then be secured cross beam joists that support a slab form or concrete mold. The screwjacks are then adjusted until the structure is level, at the appropriate height, and securely supported at all points. Once the concrete has been poured, the tower remains in place for several days, or longer, until the slab has set. Each supporting tower is then disassembled in the reverse order of the assembly and removed from the site, or to another location. Commonly owned U.S. Pat. No. 4,470,574, which is incorporated herein by reference, discloses a typical prior art shoring frame and tower system.

The shoring towers or structures of the prior art have several disadvantages. The frames are large and unwieldy since they are welded as one piece and not adjustable. Depending on their height, it may take two or more people to place or remove them. The frames serve only one function. If single post shores are needed for reshoring the slab, they must be provided separately, and be transported to the site and separately installed after the frames and/or towers have been disassembled. This adds to the cost of constructing concrete slabs by requiring separate shoring components for shoring frames and single post shoring.

SUMMARY OF THE INVENTION

It is an object of the present invention to provide a novel shoring frame and shoring system which obviates or mitigates the disadvantages of the prior art.

It is desirable to provide a shoring structure which can be assembled and disassembled on site. It is further desirable to provide a shoring structure which is assembled from multi-use components.

In a first embodiment the present invention provides a structure for shoring a concrete slab, comprising at least two post shores having T-bolt channels running vertically along at least a portion of their length;

at least one frame member having means to slidingly engage said T-bolt channels;

releasable fastening means for lockingly connecting said frame member to said T-bolt channels to form a frame assembly; and slab support means supportingly received by said frame assembly; wherein said shoring structure is demountable.

BRIEF DESCRIPTION OF THE DRAWINGS

Preferred embodiments of the present invention will now be described, by way of example only, with reference to the attached Figures, in which.

DETAILED DESCRIPTION

Figure 1:
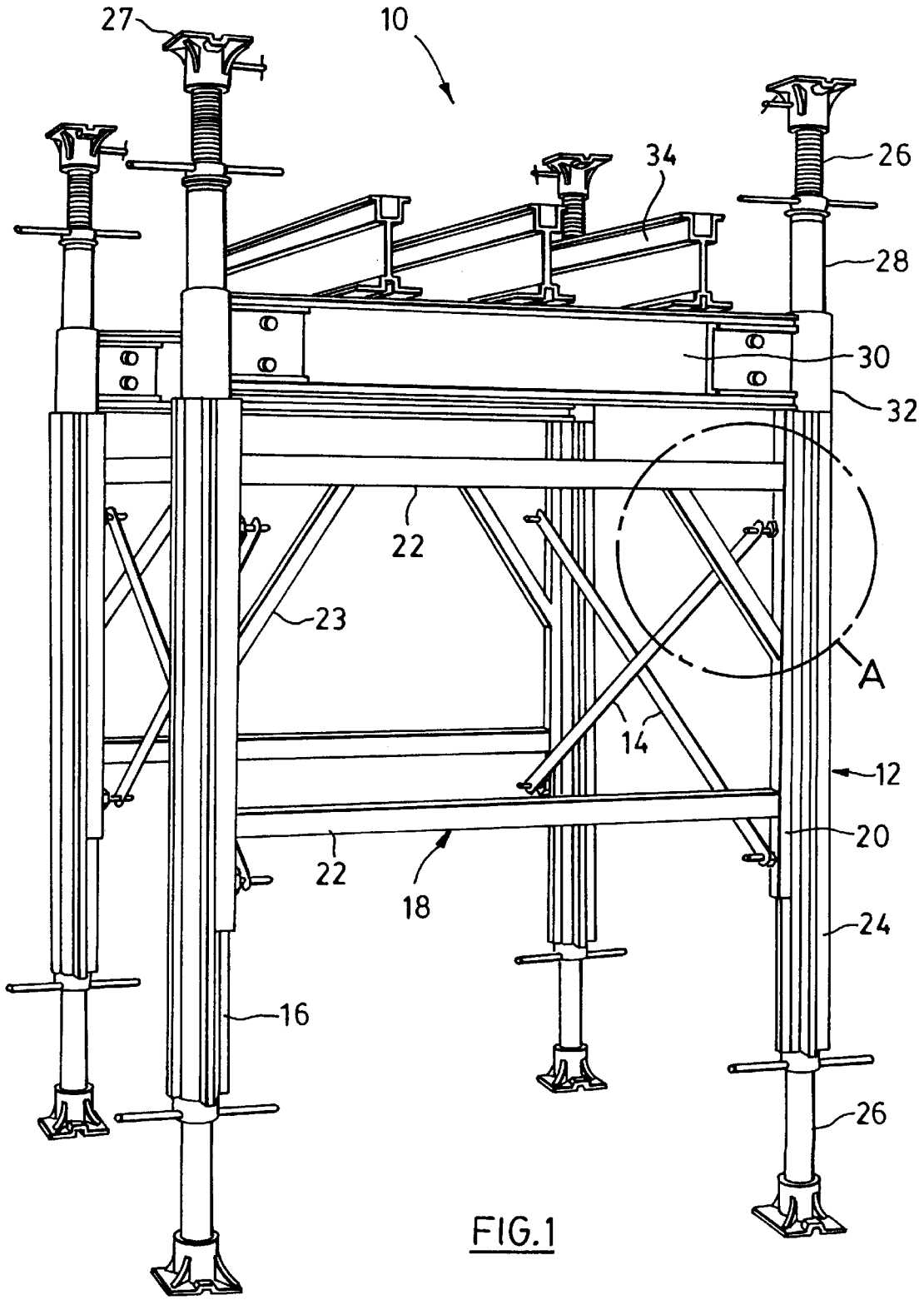
FIG. 1 shows a perspective view of a modular shoring frame in accordance with the present invention.

Referring to FIG. 1, the shoring structure 10 of the present invention is illustrated. The shoring structure 10 generally comprises frame assemblies 12 and bracing members 14. Bracing members 14 interconnect the frame assemblies 12 to provide an assembled shoring structure 10.

Frame assemblies 12 generally consist of vertical post shores 16 laterally spaced apart by a demountable ledger member 18. Ledger member 18 has vertical sidebars 20 adapted to connect to post shores 16, as will be more fully explained below. Vertical sidebars a 20 are spaced apart by ledgers 22. Angle braces 23 give added strength and rigidity to ledger member 18. Ledgers 22 are conventionally vertically spaced two to six feet apart.

Post shore 16 generally consists of a T-bolt channel member 24 surmounted by screwjack assemblies 26 at one or both ends. Extension tubes 28 can replace or supplement the screwjack assemblies 26. As will be understood by those of skill in the art, the length of a post shore 16 can be extended by joining two or more T-bolt channel members 24 end to end with appropriate couplers. T-bolt channel members 24 can be supplied in various lengths, generally up to sixteen feet. With the addition of extension tubes 28 and screwjack assemblies 26, it is possible to provide single post shores 16 up to twenty-four feet in length without compromising strength or rigidity.

A saddle beam 30 spans the distance between post shores 16. The saddle beam 30 has sleeves 32 at either end which have an inner diameter adapted to fit over extension tubes 28, and which are supported by the upper edge of T-bolt channel member 24. As will be understood by those of skill in the art, saddle beams 30 enable a soffit of drop beams to be supported at one level and the slab at another level, thus enabling the slab support to be removed without disturbing the support under the drop beams.

Extension tubes 28 can be installed at the top or bottom of the post shores 16. This can result in a significant reduction of the number of screwjack assemblies 26 required for a specific application. Consequently, there is a more efficient utilization of equipment and attendant cost reductions. Levelling, or adjusting the height, of a post shore 16 is less time consuming and more accurate than adjusting height with screwjacks 26 alone, especially when used on flat level concrete.

Extension tube plates 27 secure the ends of the extension tube 28 or the post shore 16 to conventional aluminum stringers when a screwjack 26 is not required.

As will be understood by those of skill in the art, when shoring structure 10 is assembled, beam joists 34, or other structural support members such as plywood sheeting can then be supported across saddle beams 30, as illustrated, and/or across the upper surface of post shores 16.

Figure 2:
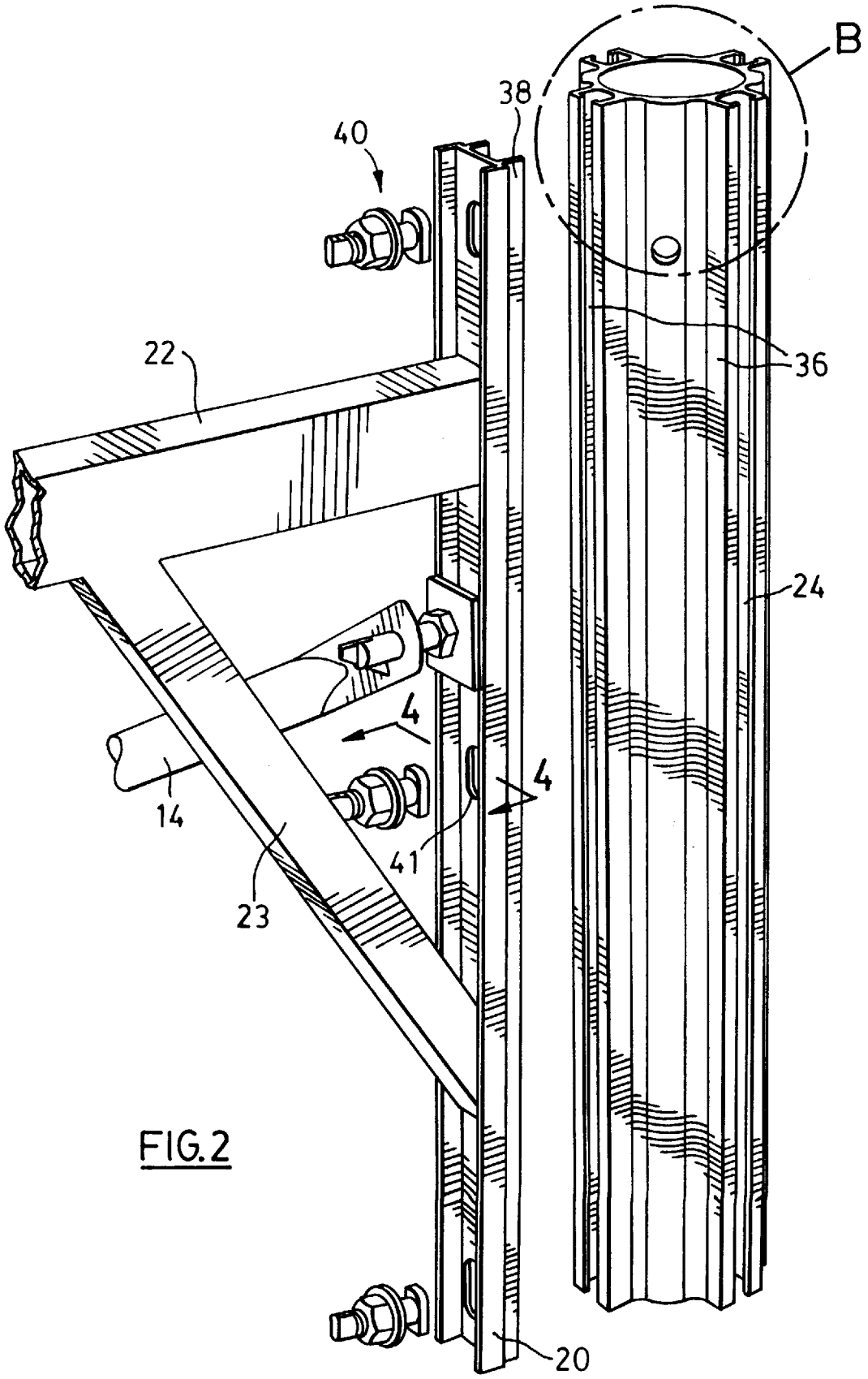
FIG. 2 shows an exploded perspective view of portion "A" of FIG. 1.
Figure 3:
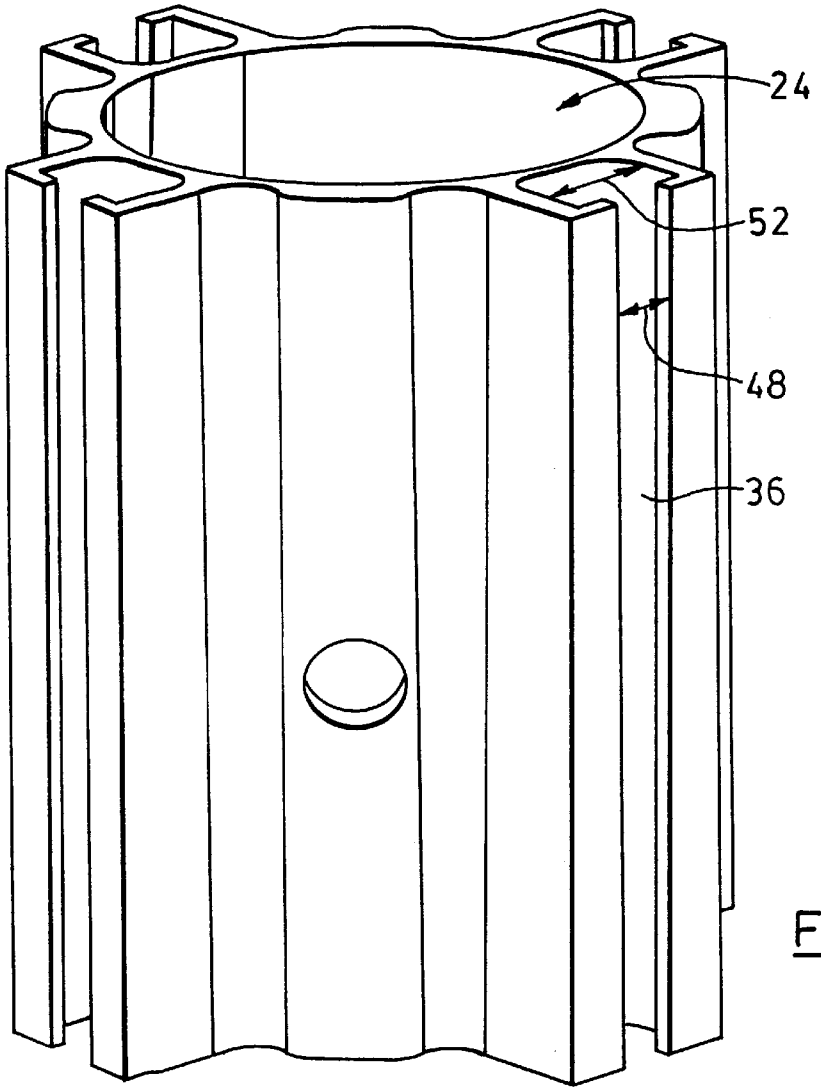
FIG. 3 shows a perspective view of portion "B" of FIG. 2.

Referring to FIGS. 2 and 3, a portion of the frame assembly 12, marked "A" in FIG. 1, is illustrated. T-bolt channel member 24 has four outwardly extending T-bolt channels 36. FIG. 3 shows, in greater detail, T-bolt channel member 24. Vertical sidebar 20 is provided with an overlapping channel 38 which is adapted to slidingly engage with T-bolt channel 36. Vertical sidebar 20 is releasably connected to the T-bolt channel 36 using conventional T-bolt fasteners 40 which are inserted through apertures 41 in sidebar 20 to engage T-bolt channel 36.

Figure 4:
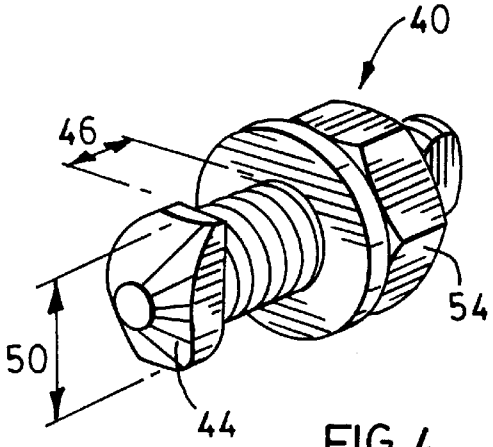
FIG. 4 shows a perspective view of a T-bolt.

As shown in FIG. 4, the T-bolt fastener 40 comprises a bolt 42 having a head 44 having a width 46 substantially equal to an opening 48 of T-bolt channel 36. Head 44 has a length 50 approximately the inner width 52 of T-bolt channel 36. In this manner, the head 44 can be inserted in the channel 36 anywhere along the length thereof, twisted 90° to engage the overlapping edges of channel 36, and locked therein by tightening the nut 54 along the thread of the T-bolt 42.

Figure 6:
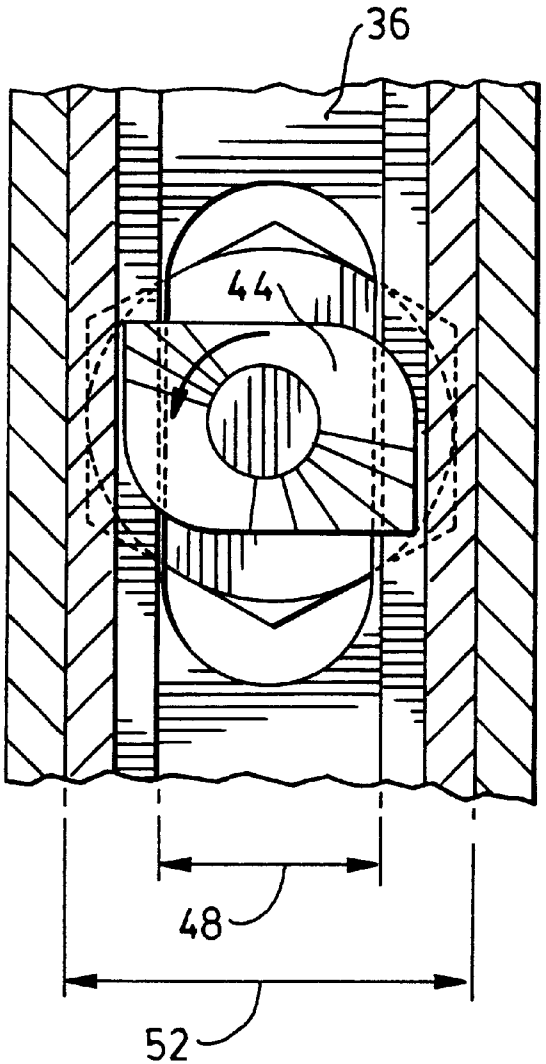
FIG. 6 shows the t-bolt of FIG. 4 in a locked position.
Figure 5:
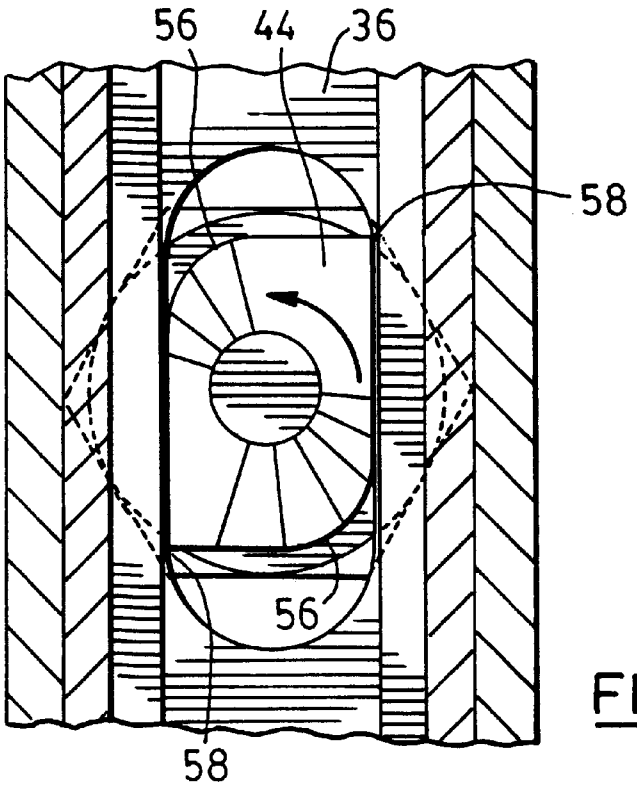
FIG. 5 shows the T-bolt of Fig.4 in an unlocked position.

FIGS. 5 and 6 shown the T-bolt fastener 40 in an unlocked and locked engagement, respectively. As will be noted, the opposite rounded corners 56 and sharp corners 58 restrict head 44 to movement in the direction of the arrow within channel 36.

In use, shoring structure 10 is assembled using well known construction techniques. The ledger members 18 are connected to post shores 16 by inserting the heads 44 of T-bolt fasteners 40 through apertures 41 of sidebars 20. The bolt 42 is rotated 90° for retaining therein and nut 54 threadingly engages the T-bolt 40, firmly fastening the ledger member 18 to post shore 16. The frame assemblies 12 thus constructed are then positioned and angle braces 14 are used to interconnect two or more frame assemblies 12 to form a tower structure. Saddle beams 30 and beam joists 34 can then be installed and the structure can be adjusted to the correct height by turning conventional screwjacks 26. Structure 10 can be disassembled in the reverse order. If desired, post shores 16 can be left in place when disassembling structure 10. The remaining components of structure 10 can be re-used elsewhere.

As will be appreciated, the provision of four T-bolt channels 36 on T-bolt channel member 24 allows other frame assemblies 12, or other components, to be attached to channel member 24. In this manner, a larger structure 10 can be assembled as desired.

As is apparent, the required floor space for erecting a structure 10 is minimized. Shoring structure 10 can be made of aluminum to reduce the weight of the structure without sacrificing strength. The structure 10 can achieve safe working loads up to 22,700 kg per frame assembly 12 at a safety factor of 2:5:1, or as high as 27,000 kg. at a safety factor of 2:1. Transportation, storage, assembly, disassembly and handling cost are reduced due to the light weight, modular nature, and multi-use features of the structure 10 and its various components.

Further advantages of the present invention will be apparent to those of skill in the art. The post shores can be used to form the legs of the shoring structure, or separately as single post shores. The post shores can also be extended to easily build higher towers for supporting slabs at greater heights. Since the components of the shoring structure are made from extruded high strength aluminum, a single person can generally transport and erect a post shore with heights of 20 feet or more. The high strength of the resulting support structures also means that less bracing is required than in conventional structures. This can cause less congestion on a work site. The multiple T-bolt channels on the legs can make it simple to create towers of different shapes and sizes. In addition, supplementary bracing can be added to a tower or to a single post shore by attaching braces to the T-bolt channels.

It will be apparent to those skilled in the art that the foregoing is by way of example only. Modifications, variations and alterations may be made to the described embodiments without departing from the scope of the invention which is defined solely in the claims.

We claim:

1. A shoring structure for a concrete slab, comprising at least four post shores, each said post shores having at least four T-bolt channels running lengthwise along at least a portion of its length;

ledger members for interconnecting said post shores, in pairs, to form frame assemblies;

bracing members for interconnecting said frame assemblies to form a free-standing structure;

support beams attached between said post shores to support a concrete slab; and releasable fasteners for engaging selected T-bolt channels to fasten said ledger members and said bracing members to said post shores to achieve a desired shoring configuration.

2. A shoring structure according to claim 1, wherein each post shore includes a plurality of post sections combined to extend the length of the post shore.

3. A shoring structure according to claim 1, wherein said structure is aluminum.

4. A shoring structure according to claim 1, wherein said releasable fastening means are T-bolt fasteners having a first position for slidingly engaging a T-bolt channel, and a second position for lockingly engaging a T-bolt channel.

5. A shoring structure according to claim 1, wherein said bracing members include braces.

6. A shoring structure according to claim 1, wherein a plywood sheet, placed across said support beams, further supports the concrete slab.

7. A shoring structure according the claim 1, wherein the bracing members, the ledger members and the support beams can be selectively detached to leave in place one or more of said posts shores after said slab has cured sufficiently.

* * * * *